United States Patent [19]

Kohl

[11] 4,236,976

[45] Dec. 2, 1980

[54] PREVENTING STAINS ON MULTIPLE-ELECTROPLATED ARTICLES

[75] Inventor: Paul A. Kohl, Chatham, N.J.

[73] Assignee: Bell Telephone Laboratories, Incorporated, Murray Hill, N.J.

[21] Appl. No.: 92,472

[22] Filed: Nov. 8, 1979

[51] Int. Cl.[3] ..... C25D 5/02; C25D 5/34; C25D 5/52

[52] U.S. Cl. ..... 204/15; 204/32 R; 204/40

[58] Field of Search ..... 204/15, 32 R, 36, 40

[56] References Cited

U.S. PATENT DOCUMENTS

| | | | |
|---|---|---|---|
| 3,242,090 | 3/1966 | Grunwald | 252/79.1 |
| 3,819,494 | 6/1974 | Fountain | 204/146 |
| 3,935,005 | 1/1976 | Solidum | 75/105 |
| 4,153,523 | 5/1979 | Koontz | 204/129.6 |

OTHER PUBLICATIONS

Electroplating and Metal Finishing, vol. 25, No. 11, pp. 9–16 (1972).

Plating, vol. 58, p. 893 et seq., (1971).

*Primary Examiner*—T. M. Tufariello

*Attorney, Agent, or Firm*—Peter V. D. Wilde

[57] ABSTRACT

A method is shown of reducing the incidence of stains on objects, such as electrical contact pins, having two or more electroplated regions. An exemplary embodiment is the case of two gold electroplating operations. After the first gold electroplating operation, the article is passed through a cyanide etching bath. The article is typically then polished, and then plated in a second electroplating operation. The etching bath removes extraneous gold deposits that can cause stains. A typical etching solution is a 0.01 molar concentration of KCN etchant and 0.1 molar KOH or $K_3PO_4$ buffer in a water solution, typically applied by spraying.

11 Claims, 3 Drawing Figures

PREVENTING STAINS ON MULTIPLE-ELECTROPLATED ARTICLES

BACKGROUND OF THE INVENTION

1. Field of the Invention

This invention relates to electroplating articles with gold and other lustrous metals and in particular to preventing stains on such articles.

2. Description of the Prior Art

Metal electroplating is used in a wide variety of industries. These include the manufacture of ornamental objects, as well as the production of electrical and electronic components. Not only does the plated metal typically have a high luster, but it may also serve to protect the underlying layer from attack by a wide variety of chemicals and substances present in the environment. In addition, the low electrical resistance of certain metals, including gold, makes them useful coating material for electrical switch contacts, relay contacts, connectors, etc.

A standard quality control check for the electroplating process is the final appearance of the article. A high luster usually indicates that the surface is smooth, and no defects resulted from the plating operation. Although an article having a discolored portion may be functionally acceptable, the discoloration often signals the advent of processing problems. In particular, a stain or tarnish on the surface may indicate contaminants in the electroplating bath or nonuniformity in the plating operation. In any case, stains are frequently a ground for rejecting an article. This typically leads to reclamation operations when the plated metal is of high value, such as gold or platinum, resulting in added expense.

Recently, electroplating operations have been adapted to continuously moving strip-plating lines, such as that shown in U.S. Pat. No. 4,153,523, assigned to the same assignee as the present invention. A typical article, such as an electrical contact pin, may have more than one region of the article plated with gold. This typically requires passing such an article through more than one gold plating operation. To increase production speed, a recent trend is the use of spray plating cells for the electroplating of gold. Regardless of the particular metal or process involved, it is desirable to reduce the incidence of staining of electroplated articles.

SUMMARY OF THE INVENTION

I have invented a method of elminating one cause of staining of electroplated articles. This method results from the discovery that one cause of staining is the inadvertent electroless deposition of metal onto an article by metallic salts present in the mist surrounding the article during a first electroplating operation. The electroless deposits cause roughness of the surface in a subsequently electroplated portion, yielding a stain on the article. I have found that such stains can be prevented by removing the electroless deposits on the article prior to the subsequent electroplating process. In a preferred embodiment, an etching fluid is applied to the article to remove the electroless deposits.

DETAILED DESCRIPTION

The following description relates to reducing the incidence of staining of multiply-plated articles by eliminating one cause of such staining. The description is given mainly in terms of multiple gold plating operations, which are currently of high commercial interest. However, the principles described can be applied to other lustrous metals for which stains are to be avoided, as will be discussed further below.

Figure 1:
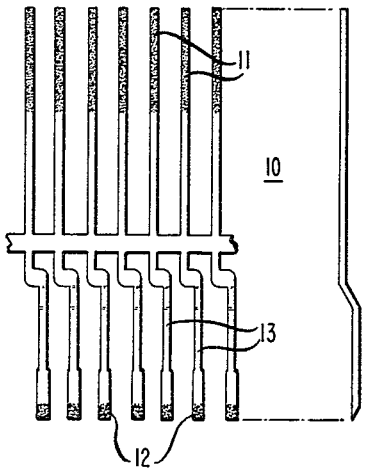
FIG. 1 shows an electrical contact pin having two gold electroplated regions.

Referring to FIG. 1, a continuous strip of electrical contact pins 10 is shown. These pins are comprised primarily of a substrate material, commonly copper, or a copper alloy, such as copper-nickel-tin, brass, or phosphorus-bronze. The contact pins typically comprise two gold electroplated regions 11 and 12. These two regions may be entirely noncoincident, as shown in FIG. 1, or may partially overlap. The characteristics of these gold electroplated regions may differ. For example, region 12 may be designed as a contact for multiple connect-/disconnect operations, whereas region 11 may be a wire wrap terminal. Depending on their intended use, the gold layers may be plated on different substrate material. Typically, the gold layer of region 11 is plated directly on a copper substrate, whereas the gold layer of region 12 is plated on a nickel overlay on top of the copper substrate. The gold layer of region 12 may alternately be plated directly on the copper substrate, with the nickel overlay omitted.

As used hereafter, the term "substrate material" means the material onto which a particular metal layer is deposited, whether such substrate material is copper, nickel, or some other material, including overlay material. The substrate material in the first plated region, (the "first substrate material") may be the same as, or different from, the substrate material in the second plated region (the "second substrate material"). Furthermore, the term "gold" includes gold alloys, with certain amounts of other materials, typically including cobalt, being added to obtain desirable properties such as hardness and wear resistance. The terms "first plating operation" and "second plating operation" refer only to the sequence of the two electroplating operations. Other electroplating operations and other processing operations may precede or follow the "first" and "second" plating operations, or may be interposed between them.

Figure 2:
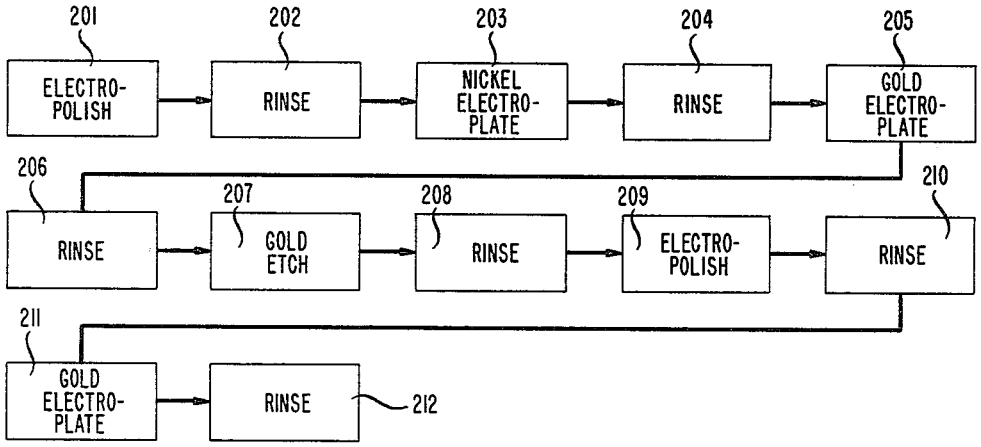
FIG. 2 shows a typical sequence of operations in a continuous plating line, having two gold electroplating operations and the inventive "gold etch" operation.

A typical sequence of operations is shown in FIG. 2. These operations may advantageously be carried out in the continuous strip line plating apparatus shown in U.S. Pat. No. 4,153,523, noted above. The electropolish steps 201 and 209 remove a small portion of a substrate material prior to electroplating on the substrate material. Typically 2 microns of the substrate is removed in order to eliminate surface contaminants and provide a smoother surface for the subsequent plating steps. A nickel-plating operation (203) is typically provided for region 12, as noted above. Other base metals can be used, or this operation may be omitted as noted above. The first gold electroplating operation (205) plates region 12 of the article. Following the gold electroplating is electropolishing operation 209. This typically polishes region 11 of article 10 in order to prepare region 11 for the second gold electroplating operation 211. These operations are typically interspersed with rinse cells to prevent contamination of one plating or polishing solution with another.

I have discovered that in a typical multiple gold electroplating operation, such as that described above, gold present in the mist surrounding the first gold electroplating operation (205), which operation is intended to plate region 12, is deposited on part of region 11. This is due to the gold being plated directly from the gold salts in the mist surrounding the plating bath onto the region 11. With the recent trend toward spray plating cells, the amount of mist surrounding the plating bath is greatly increased over that formerly present, leading to a greater incidence of staining. This typically occurs according to the following equation, wherein a gold cyanide plating solution is used, and the substrate portion of region 11 comprises copper.

$$Au(CN)_2^- + Cu \rightarrow Cu(CN)_2^- + Au^O$$

This reaction occurs, for example, with a typical gold plating solution comprising 30 grams of $KAu(CN)_2$ per liter of water, with a citric acid buffer providing a pH of approximately 4. The result of this reaction is that some of the copper on the substrate goes into the cyanide salt solution, whereas some of the gold from the cyanide salt solution is plated directly onto the copper substrate. This plating occurs without the benefit of external electric current (i.e., electroless), and is a result of the difference in the electronegativity of the gold and the copper, among other things. The electroless plated gold is herein also referred to as the "gold deposits" or the "salt-deposited gold."

The salt-deposited gold typically has a thickness in the range of 0.005 to 0.1 microns. When region 11 is subsequently electroplated with gold, the gold plated upon the electroless deposits will be stained. This is because the gold plated on the electroless deposits is rough at the surface. The surface roughness is due to a number of factors, including the fact that the surface of the electroless deposited gold is uneven. Also, the height of the gold deposits will be different from that of the substrate material, and the potential difference between the gold and copper substrate will cause a slight difference in plating rates. The stains thus produced are typically circular or oval shaped, and typically have a diameter in the range of 0.2 to 1.0 mm, in the case wherein the first gold electroplating operation is a spray plating operation onto a connector pin as shown.

If the article is polished after the first gold electroplating operation but before the second gold electroplating operation, then the staining effect of the gold deposits is increased. This is because the gold is typically more resistant to removal by the polishing operation, which is typically accomplished by the use of a polishing solution, than is the substrate material. This means that a gold deposit will protect a small portion of the substrate from the polishing solution and will produce a small mound after the polishing operation has removed a layer of the surrounding substrate material. This mound will typically be about 2 microns high, as this is typically the amount of substrate materials removed by polishing. This mound will cause even more surface roughness after the second electroplating operation, yielding an even more evident stain.

A solution to this problem is to remove the gold that has been inadvertently deposited in the second region before the second gold electroplating operation occurs. If a polishing operation precedes the second gold electroplating operation, the gold deposits are preferably removed prior to such polishing operation. This can be done, for example, by an etching bath that removes the salt-deposited gold in the second region. A typical etching solution is an approximately 0.001 to 0.1 molar water solution of potassium cyanide (KCN). At the preferred 0.01 molar concentration of KCN, typical gold deposits are removed in less than 10 seconds. However, other gold etching solutions typically comprising cyanide may also be used; see, for example, U.S. Pat. Nos. 3,242,090; 3,819,494; and 3,935,005. The salt-deposited gold is typically removed by the cyanide etching solution according to the following equation:

$$O_2 + 4Au + 8CN^- + 4H^+ \rightarrow 4Au(CN)_2^- + 2H_2O$$

The oxygen required for this reaction typically is provided from the air.

When removing the salt-deposited gold spots, the potassium cyanide etching solution described herein removes substantially none of the copper substrate material, when applied as described herein. The etching operation for removing the salt-deposited metal is thus distinguished from the "polishing" operation, in that the latter removes the substrate material at a faster rate than it removes the salt-deposited metal. As this gold etching operation follows the first gold electroplating operation, a buffer material is typically added to neutralize the acid dragged into the etching cell from the plating cell. For this purpose, typically a 0.1 molar concentration of KOH or $K_3PO_4$ in water is used.

Figure 3:
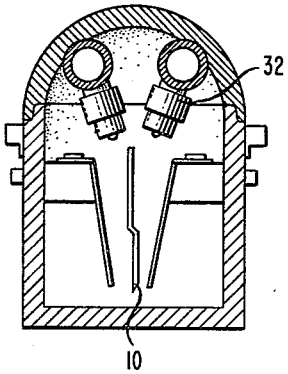
FIG. 3 shows a cross section view of a typical spray cell suitable for applying the etching solution.

A preferred method of applying the above-named etching solution is by means of a spray cell; see FIG. 3. The cell, approximately 1 foot (0.3 mtr) long, comprises approximately 6 nozzles (32) through which the etching solution is flowed at a rate of from 1 to 4 gallons (4 to 16 liters) per minute onto the article (10). The removal rate is approximately 0.06 microns of gold per minute. Since a given article is present in the etching bath for approximately one-half minute, the amount of gold removed is approximately 0.03 microns. The etching solution may be applied to the entire article, including the first gold electroplated region (12), since the amount of gold removed is much less than that plated on region 12. Alternately, the etching solution may be applied only to the second plated region (11), wherein the undesired gold spots occur. By limiting the maximum gold removal to 0.1 microns, it can be seen that the etching operation of the present invention is distinguished from cases in which it is desired to reclaim gold on electroplated articles, since the minimum gold thickness is typically at least 0.2 microns on items that have been electroplated with gold. Furthermore, electroless deposits of metal are removed by the present process, whereas electroplated metal is removed in typical reclamation operations.

It can be seen that an uneven surface will follow any polishing operation if spots of a material are present on the surface of the substrate being polished that are removed at a slower rate than the substrate material itself. A typical purpose of a plated metal in commercial applications is to protect the substrate from wear or chemical attack. Therefore, the salt-deposited spots of such a metal will typically be more resistant to removal by polishing than will be the substrate material, and mounds will result.

Numerous other plated metals can be treated to remove unwanted electroless deposits, in accordance with the principles described herein. When a given metal plating solution comes in contact with a given substrate metal, general chemical considerations known in the electrochemical art can be used to estimate the likelihood that electroless deposition will occur. Two important considerations are how "noble" the two metals are, and how readily the two metals form complexes with the ions in the plating solution. If the metal in the plating solution is more noble (less easily oxidized) than the metal in the substrate, then an electroless deposition of the metal from the plating solution onto the substrate is favored. If the substrate metal forms stronger complexes as compared to the plating metal, it is likely that electroless deposition of the plating metal onto the substrate will occur. Standard tables known in the electrochemical art are available to indicate how easily such metal complexes, for example metallic cyanide complexes, are formed. Therefore, the likelihood of electroless deposition can be reasonably accurately estimated for both current electroplating solution/substrate combinations, and those yet to be devised in the future.

The electroless deposited metal resulting from the first plating operation need not be the same as the metal deposited in the second plating operation for stains to occur. For example, if electroless deposits of gold result from a first electroplating operation, stains will result if any lustrous metal is then electroplated on the region having the electroless gold deposits. Therefore, the terms "first metal" and "lustrous metal" as used herein may refer to the same metal, or to different metals.

Lustrous plating metals frequently used, besides gold, include platinum, palladium, silver, zinc, cadmium, ruthenium, rhodium, and irridium. It is known that typical plating solutions of platinum, palladium, rhodium, irridium, and silver will form electroless deposits on copper. Various cyanide, chloride, and other etching solutions are known in the art to remove various of the above-named metals, among others; see, for example, "Chemical and Electrochemical Stripping of Metallic Deposits," H. Dillenberg, Electroplating and Metal Finishing, Vol. 25, No. 11, pp. 9–16, November 1972. In view of the relatively high cost of gold, it can be expected that these other metals, especially palladium and ruthenium, will find increasing use in electrical contacts in connectors, switches, and relays, among other items. Alloys of the above-named lustrous metals can also be expected to be used, and are also included herein. Of course, more than two electroplating operations may be contemplated, and an etching bath may be located between each of the operations to remove unwanted spots in portions that are to be electroplated. Other removal techniques, e.g. plasma or electrolytic, may of course also be contemplated. All such variations and deviations which basically rely on the teachings through which this invention has advanced the art are properly considered to be within the spirit and scope of this invention.

I claim:

1. A method of manufacturing an article comprising the steps in sequence of:

(a) electroplating a first metal onto a first substrate material in a first region of the article; and (b) electroplating a lustrous metal onto a second substrate material in a second region of the article;

wherein said first metal is the same as, or different than, said lustrous metal, and wherein said first substrate material is the same as, or different than, said second substrate material, CHARACTERIZED by steps comprising removing electroless deposits of said first metal from said second substrate material in said second region of the article after said electroplating of said first metal and before said electroplating of said lustrous metal.

2. A method of manufacturing an article comprising the steps in sequence of:

(a) electroplating a first metal onto a first substrate material in a first region of the article;

(b) polishing a second substrate material in a second region of the article; and (c) electroplating a lustrous metal onto said second substrate material in said second region of the article;

wherein said first metal is the same as, or different than, said lustrous metal, and wherein said first substrate material is the same as, or different than, said second substrate material, and wherein said first metal is more resistant to removal by said polishing than is said second substrate material, CHARACTERIZED by steps comprising removing electroless deposits of said first metal from said second substrate material in said second region of the article after said electroplating of said first metal and before said polishing of said second substrate material.

3. The method of claims 1 or 2 FURTHER CHARACTERIZED in that said lustrous metal is a metal, or an alloy that includes one or more metals, selected from the group consisting of gold, platinum, palladium, silver, zinc, cadmium, ruthenium, rhodium, and irridium.

4. The method of claim 3 FURTHER CHARACTERIZED in that said first metal is electroplated onto said first region by steps comprising spraying a solution of said first metal onto said first region.

5. The method of claim 4 FURTHER CHARACTERIZED in that the step of removing said first metal is accomplished by steps comprising applying an etching fluid to at least said second region of the article.

6. The method of claim 5 FURTHER CHARACTERIZED in that said first metal is gold or a gold alloy, said second substrate material is copper or a copper alloy, and said solution of said first metal comprises gold cyanide.

7. The method of claim 6 FURTHER CHARACTERIZED in that said etching fluid is a cyanide etching fluid.

8. The method of claim 7 FURTHER CHARACTERIZED in that said cyanide etching fluid comprises a 0.001 to 0.1 molar water solution of KCN.

9. The method of claim 8 FURTHER CHARACTERIZED in that said cyanide etching fluid further comprises approximately a 0.1 molar water solution of either KOH or $K_3PO_4$, or both.

10. The method of claim 8 FURTHER CHARACTERIZED in that said etching fluid is applied by spraying onto said article.

11. An article manufactured according to the method of claim 1.

* * * * *

UNITED STATES PATENT AND TRADEMARK OFFICE

CERTIFICATE OF CORRECTION

PATENT NO. : 4,236,976

DATED : December 2, 1980

INVENTOR(S) : Paul A. Kohl

It is certified that error appears in the above-identified patent and that said Letters Patent are hereby corrected as shown below:

In the title, change "Multiple" to --Multiply--.

Column 1, line 3, "Multiple" should read -- Multiply --.

Signed and Sealed this

*Seventeenth* Day of *March 1981*

[SEAL]

*Attest:*

RENE D. TEGTMEYER

*Attesting Officer*

*Acting Commissioner of Patents and Trademarks*